US010446946B2

(12) United States Patent
Wu et al.

(10) Patent No.: US 10,446,946 B2
(45) Date of Patent: Oct. 15, 2019

(54) CONDUCTIVE COMPONENT STRUCTURE FOR WIRE CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Ming-Shan Tai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/024,994

(22) Filed: Jul. 2, 2018

(65) Prior Publication Data

US 2019/0013598 A1 Jan. 10, 2019

(30) Foreign Application Priority Data

Jul. 6, 2017 (TW) ..... 106122722 A

(51) Int. Cl.

| | |
|---|---|
| ***H01R 4/48*** | (2006.01) |
| ***H01R 4/26*** | (2006.01) |
| ***H01R 13/24*** | (2006.01) |
| ***H01R 9/24*** | (2006.01) |
| ***H01R 13/432*** | (2006.01) |
| ***H01R 13/502*** | (2006.01) |
| ***H01R 11/28*** | (2006.01) |
| *H01R 12/57* | (2011.01) |

(52) U.S. Cl.

CPC ..... *H01R 4/4818* (2013.01); *H01R 4/26* (2013.01); *H01R 4/489* (2013.01); *H01R 4/4827* (2013.01); *H01R 9/2416* (2013.01); *H01R 11/28* (2013.01); *H01R 13/24* (2013.01); *H01R 13/432* (2013.01); *H01R 13/502* (2013.01); *H01R 12/57* (2013.01)

(58) Field of Classification Search

CPC ..... H01R 4/48; H01R 4/4818

See application file for complete search history.

(56) References Cited

U.S. PATENT DOCUMENTS

| | | | | |
|---|---|---|---|---|
| 2,617,844 A * | 11/1952 | Sanda | H01R 4/4818 | 439/441 |
| 6,128,181 A * | 10/2000 | Higami | H01R 4/4818 | 174/252 |
| 8,485,841 B2 * | 7/2013 | Schrader | H01R 4/4827 | 439/441 |
| 8,794,994 B2 * | 8/2014 | Kollmann | H01R 4/4836 | 439/441 |

(Continued)

*Primary Examiner* — Tho D Ta

(74) *Attorney, Agent, or Firm* — Rosenberg, Klein & Lee

(57) ABSTRACT

A conductive component structure for wire connection terminal has higher electro-conductive performance and is more securely assembled with the conductive wire. The conductive component includes a main body in the form of a plate body and a restriction body connected on the main body. The restriction body has a base section, a bow section connected with the base section and a free section connected with the bow section, which together provide elastic effect for the restriction body. When the conductive wire is plugged in to contact the conductive component, the restriction body guides the conductive wire and the rear end of the conductive wire is securely pressed and restricted between the main body and the restriction body.

30 Claims, 9 Drawing Sheets

(56) References Cited

U.S. PATENT DOCUMENTS

| | | | | |
|---|---|---|---|---|
| 2007/0072481 | A1* | 3/2007 | Edenharter ..... | H01R 4/4818<br>439/441 |
| 2017/0237184 | A1* | 8/2017 | France ..... | H01R 4/4818<br>439/843 |

* cited by examiner

CONDUCTIVE COMPONENT STRUCTURE FOR WIRE CONNECTION TERMINAL

BACKGROUND OF THE INVENTION

1. Field of the Invention

The present invention relates generally to a conductive component structure for wire connection terminal, and more particularly to a conductive component having a restriction body for guiding the conductive wire and helping in securing the conductive wire.

2. Description of the Related Art

A conventional terminal device or wire pressing terminal has an insulation case (generally made of plastic material), a metal component (or so-called electrical conductive component) and a leaf spring conductor (or so-called metal leaf spring). The metal component and the leaf spring conductor are enclosed in the insulation case to press and electrically connect with or release a conductive wire plugged in the terminal device.

Such electrical connection terminal devices include two types. The first type of electrical connection terminal device is inserted on a circuit board such as printed circuit board (PCB). The second type of electrical connection terminal device is latched with a grounding rail (or conductive rail) in a row to set up a common grounding device of an electrical apparatus or mechanical equipment for conducting out the residual voltage or static of the machine.

Such electrical connection terminal (or rail-type electrical connection terminal) generally includes an insulation case having a wire plug-in hole for the conductive wire to plug into the interior of the case. The case defines a chamber in which a conductive support (or conductive component) and a metal leaf spring are mounted. The metal leaf spring and the conductive component serve to press the conductive wire plugged into the case and contact or electrically connect with the conductive wire. Unless an operator uses a tool to extend into the case and push/press the metal leaf spring, the conductive wire cannot be released from the electrical connection or contact with the metal leaf spring and the conductive component.

The assembling structure of the conventional electrical connection terminal has some shortcomings in structure and operation application. For example, when a large-diameter conductive wire is plugged into the electrical connection terminal, it often takes place that the pressing force applied by the metal leaf spring and the conductive component to the conductive wire is insufficient so that the conductive wire can be hardly securely pressed and the conductive wire is apt to rotate, deflect or swing due to incautious touch of an operator. This will lead to poor contact and insecurity.

In order to improve the shortcomings of insufficient pressing force and electro-conductive insecurity or efficiency, a conventional electrical connection terminal has been disclosed, which employs a screw to lock and restrict the conductive wire or uses double-layer metal leaf spring or thickened metal leaf spring and conductive component to increase the pressing force for the conductive wire.

However, as well known by those who are skilled in this field, it is quite troublesome and time-costing to use a screw to lock and restrict or release the conductive wire. Also, the increase of the thickness of the metal leaf spring and the conductive component will lead to increase of the manufacturing cost and it is laborious to operate the thickened metal leaf spring and conductive component. This is not what we expect.

To speak representatively, the above reveals some shortcomings existing in the conventional wire connection terminal in structure assembly design and application. In case the structure assembly of the conductive component and the metal leaf spring or leaf spring conductor is redesigned to be different from the conventional wire connection terminal, the use form of the wire connection terminal can be changed to practically widen the application range thereof.

It is found that the structural form of an optimal terminal device or conductive component must overcome or improve the aforesaid shortcomings of the conventional wire connection terminal and include several design considerations as follows:

1. In condition that the thickness of the conductive component and/or the metal leaf spring is not increased, the cooperative structures of the conductive component and/or the metal leaf spring must be able to provide sufficient pressing force so that the wire connection terminal is applicable to a large-diameter conductive wire. Also, the conductive component and/or the metal leaf spring of the electrical connection terminal must overcome the shortcomings of the conventional electrical connection terminal that the pressing force applied by the metal leaf spring and the conductive component to the conductive wire is insufficient, the conductive wire can be hardly securely pressed and the conductive wire is apt to deflect or swing due to incautious touch of an operator to lead to poor contact and insecurity.
2. In addition, the conductive component and/or the metal leaf spring of the electrical connection terminal must be free from the screw of the conventional electrical connection terminal for locking and restricting the conductive wire and eliminate the shortcoming of the conventional electrical connection terminal that it is quite troublesome and time-costing to use the screw to lock and restrict or release the conductive wire. Also, the conductive component and/or the metal leaf spring of the electrical connection terminal must improve the shortcoming of the conventional electrical connection terminal that the thickness of the metal leaf spring and the conductive component is increased to lead to increase of the manufacturing cost and it is laborious to operate the thickened metal leaf spring and conductive component.
3. Moreover, the electrical connection terminal must provide a conductive component structure, which is able to help the metal leaf spring in pressing the conductive wire and is able to guide the conductive wire and help in fixing the conductive wire so as to minimize the possibility of rotation, deflection or swing of the conductive wire.

SUMMARY OF THE INVENTION

It is therefore a primary object of the present invention to provide a conductive component structure for wire connection terminal, which has higher electro-conductive performance and is more securely assembled with the conductive wire. The conductive component is mounted in the insulation case of the terminal. The conductive component includes a main body in the form of a plate body and a restriction body connected on the main body. The restriction body has a base section, a bow section connected with the base section and a free section connected with the bow section, which together provide elastic effect for the restriction body. When the conductive wire is plugged into the case into contact with the conductive component, the restriction body guides the conductive wire and the rear end of the conductive wire is securely pressed and restricted between the main body and the restriction body to improve the shortcomings of the conventional structure that the conductive wire is apt to rotate, deflect or swing due to external force to lead to unstable contact and insecurity and affect electro-conductive efficiency.

In the above conductive component structure for wire connection terminal, the restriction body is provided with an elastic body for enhancing the action force of the restriction body for elastically pressing and restricting the conductive wire so as to minimize the possibility of deformation of the restriction body. The elastic body is a ring-shaped body or a substantially Ω-shaped body or an elastic plate body.

In the above conductive component structure for wire connection terminal, an arched depression (directed to the main body) is formed on the restriction body between the bow section and the free section. A retarding section is disposed in the depression, whereby when the conductive wire is plugged in, the retarding section can prevent the conductive wire from rotating and avoid unstable assembling.

In the above conductive component structure for wire connection terminal, the main body or the restriction body is provided with a stop section positioned in the area of the bow section or in the path of the conductive wire plugged into the conductive component to restrict the plug-in length or distance of the conductive wire. The two end sections of the main body are formed with bent edges upward extending from the lateral sides, whereby the two end sections of the main body are formed with a structure with an arched cross section. The depression of the restriction body and the two end sections of the main body together define a mouth section. The bent edges or the structure with the arched cross section can help in guiding the conductive wire to pass through the mouth section into the conductive component to be elastically securely pressed by the restriction body.

The present invention can be best understood through the following description and accompanying drawings, wherein:

DETAILED DESCRIPTION OF THE PREFERRED EMBODIMENTS

Figure 1:
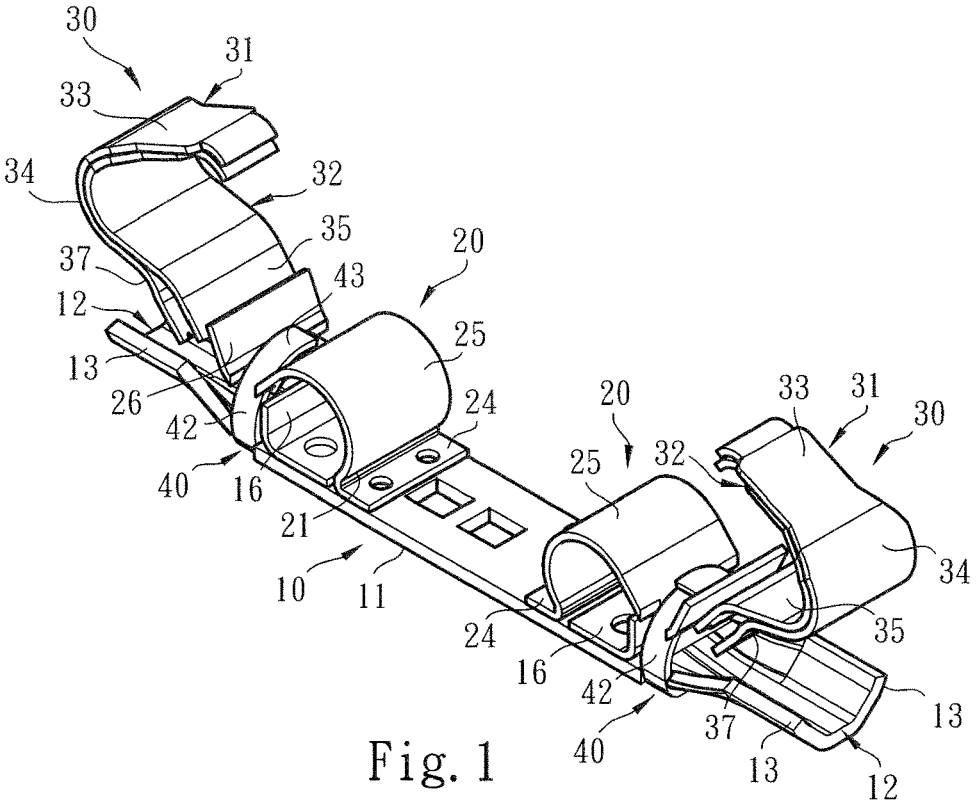
FIG. 1 is a perspective view of the conductive component of the present invention.
Figure 2:
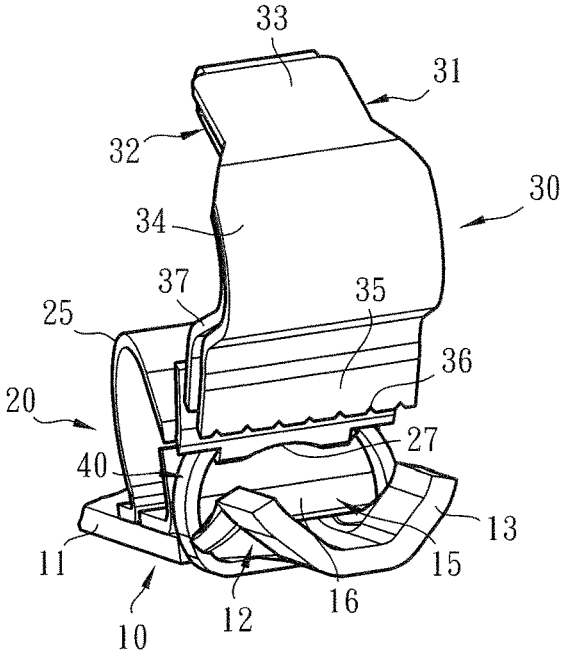
FIG. 2 is a perspective view showing the structure of a part of the present invention.
Figure 3:
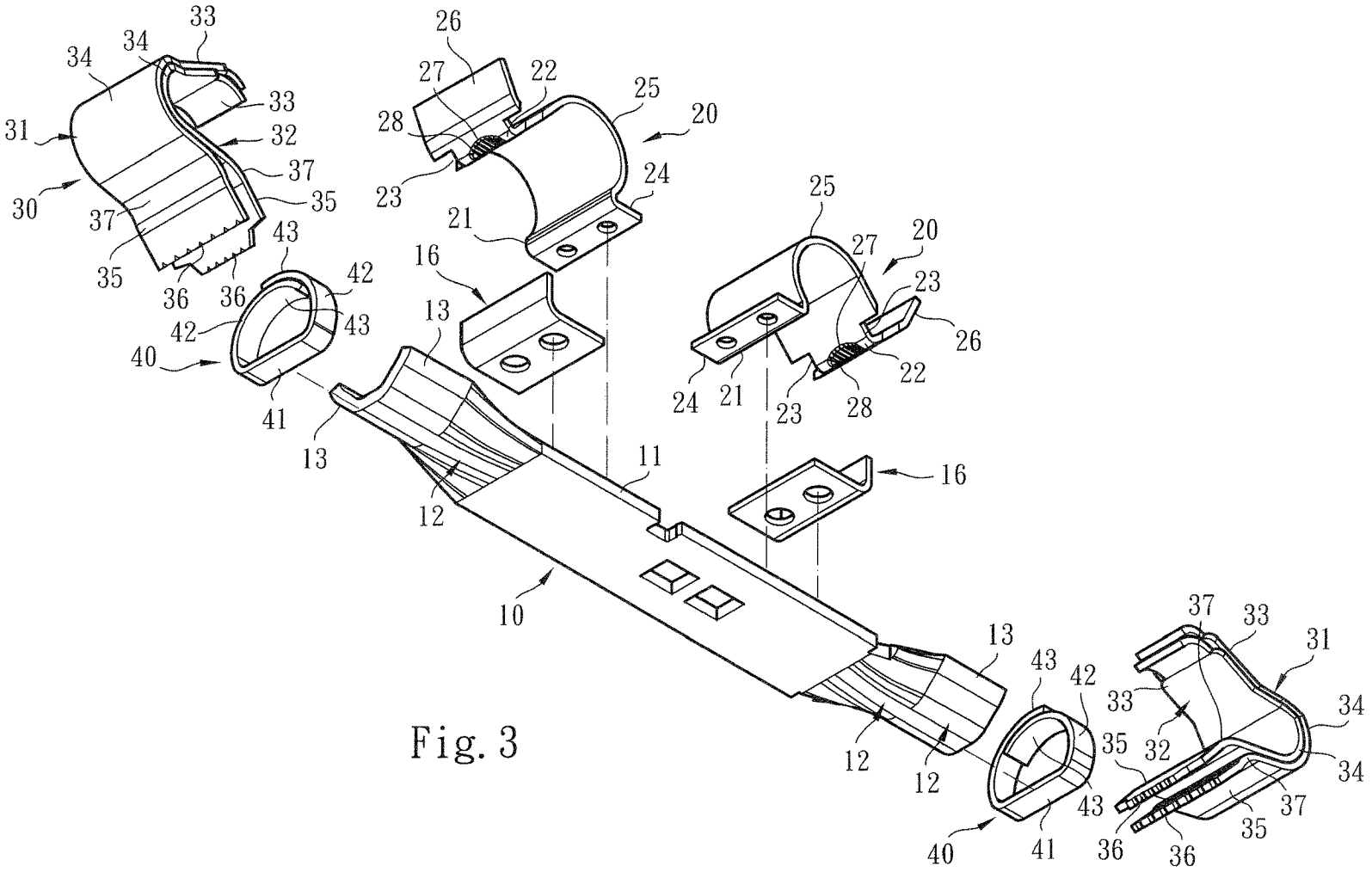
FIG. 3 is a perspective exploded view according to FIG. 1, showing the structures of the conductive component, the metal leaf spring and the elastic body.

Please refer to FIGS. 1, 2 and 3. The conductive component structure for wire connection terminal of the present invention includes an assembly of a main body 10 and a restriction body 20. The conductive component (or the main body 10 and the restriction body 20) in cooperation with metal leaf springs 30 is mounted in a case (not shown) made of insulation material to form the wire connection terminal.

The upper section, upper side, lower section, lower side and lateral side mentioned hereinafter are recited with the direction of the drawings as the reference direction.

Figure 4:
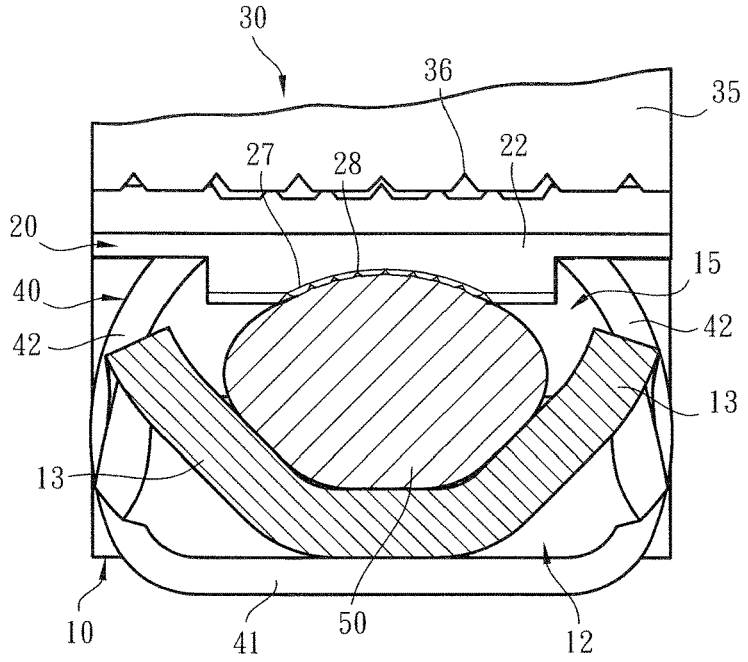
FIG. 4 is a sectional view of the present invention assembled with a conductive wire, showing that the main body and the restriction body are assembled with the conductive wire.

In a preferred embodiment, the main body 10 is selectively made of an electro-conductive material in the form of a plate body having lateral sides 11 and two end sections 12. The restriction body 20 is selectively made of an electro-conductive material (or metal material) with hardness greater than the hardness of the main body 10. The restriction body 20 can be integrally formed or assembled/disposed on (the two end sections 12) of the main body 10. The two end sections 12 of the main body 10 are formed with bent edges 13 upward extending from the lateral sides 11, whereby the two end sections 12 of the main body 10 are formed with a structure with an arched cross section as the inlets of the conductive wire. The bend edges 13 or the structure with the arched cross section serve to help in guiding a conductive wire 50 into the conductive component (as shown in FIG. 4).

Also, when the conductive wire 50 is plugged into the case, the conductive component (or the restriction body 20) serves to prevent the conductive wire 50 from thrusting, cutting or scraping the case.

As shown in the drawings, the restriction body 20 includes a base section 24 fixed on the main body 10, a bow section 25 connected with the base section 24 and a free section 26 connected with the bow section 25. The bow section 25 has an arched structure. A first bent section 21 is formed between the base section 24 and the bow section 25 of the restriction body 20. A second bent section 22 is formed between the bow section 25 and the free section 26, whereby the free section 26 obliquely extends to the upper side of the drawing (or the upper side of the main body 10). The bow section 25 and the free section 26 together provide elastic effect for the restriction body 20.

In this embodiment, the restriction body 20 is provided with or assembled with an elastic body 40. The elastic body 40 is selectively made of an elastic electro-conductive (or metal) material in the form of a ring-shaped plate body (such as a leaf spring or the like). The elastic body 40 serves to enhance the action force of the restriction body 20 for elastically pressing and restricting the conductive wire 50 so as to minimize the possibility of deformation of the restriction body 20.

As shown in FIGS. 1, 2 and 3, the elastic body 40 includes a base section 41 connected with the main body 10 and two arched waist sections 42 extending from two ends of the base section 41 toward the upper side of the drawing (or the upper side of the main body 10). The tail ends 43 of the two waist sections 42 are overlapped with each other.

In a preferred embodiment, the restriction body 20 is formed with a recessed section 23 between the bow section 25 and the free section 26 (in the position of the second bent section 22) to help in receiving and securing the elastic body 40. However, the waist sections 42 and the tail ends 43 of the elastic body 40 are permitted to elastically expand and restore to their home positions.

As shown in FIGS. 2, 3 and 4, an arched depression 27 (directed to the main body 10) is formed on the restriction body between the bow section 25 and the free section 26 (in the position of the second bent section 22). A retarding section 28 with recessed/raised structures is disposed in the depression 27, whereby when the conductive wire 50 is plugged in, the retarding section 28 can prevent the conductive wire 50 from rotating and avoid unstable assembling.

As shown in the drawings, the restriction body 20 (or the depression 27) and the two end sections 12 and the bent edges 13 of the main body 10 together define a (holding) mouth section 15, whereby the conductive wire 50 can be guided to pass through the mouth section 15 into the conductive component to be elastically securely pressed by the restriction body 20. Also, the (arched) depression 27 of the restriction body 20 and the bent edges 13 of the main body press and assemble with the upper section, the lower section and the lateral sides of the conductive wire 50. Such structural form also helps in increasing the electro-conductive contact area between the conductive component and the conductive wire 50 to enhance the electro-conductive performance.

In this embodiment, the metal leaf spring 30 includes a first leaf spring 31 and a second leaf spring 32. Each of the first and second leaf springs 31, 32 has a head section 33, a bight section 34 connected with the head section 33 and a tail section 35 connected with the bight section 34. The tail sections 35 of the first and second leaf springs 31, 32 are formed with saw-toothed structures 36. The head section 33 and the bight section 34 of the first leaf spring 31 are overlapped with or overlaid on the head section 33 and the bight section 34 of the second leaf spring 32. The tail section 35 of the first leaf spring 31 and the tail section 35 of the second leaf spring 35 are respectively formed with a bent section 37, whereby the tail section 35 of the first leaf spring 31 and the tail section 35 of the second leaf spring 35 are separated from each other.

Figure 5:
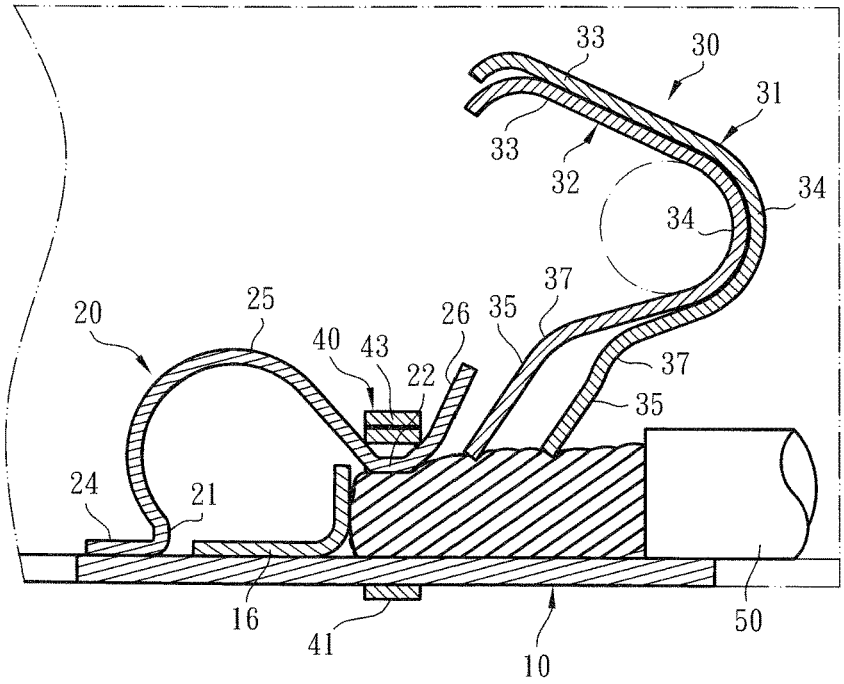
FIG. 5 is a sectional view showing the operation of the present invention, in which the conductive component and the metal leaf spring securely press and restrict the conductive wire.

Please refer to FIGS. 3, 4 and 5. In this embodiment, the conductive component (the main body 10 or the restriction body 20) is provided with a stop section 16 in the form of an L-shaped plate body. The stop section 16 is positioned in the area of the bow section 25 or in the path of the conductive wire 50 plugged into the conductive component to restrict the plug-in length or distance of the conductive wire 50. The stop section 16 is selectively made of an electro-conductive material to increase the electro-conductive contact area between the conductive component and the conductive wire 50.

As shown in FIGS. 4 and 5, when the conductive wire 50 is plugged into the conductive component, the bent edges 13 of the main body 10 serve to guide the conductive wire 50 to pass through the mouth section 15 along the main body 10. In addition, the restriction body 20 cooperates with the elastic body 40 to elastically expand, whereby the second bent section 22 and the depression 27 elastically securely press and restrict the conductive wire 50.

As shown in the drawings, the tail section 35 of the first leaf spring and the tail section 35 of the second leaf spring 32 can respectively form a pressing point against the conductive wire 50. The second bent section 22 of the restriction body 20 cooperatively presses and restricts the conductive wire 50, whereby a multipoint system for fixing the conductive wire 50 is set up. Accordingly, the possibility of rotation, deflection or swing of the conductive wire due to collision of external force or assembling process is minimized.

FIG. 5 also shows that the tail section 35 of the second leaf spring 32 and/or the tail section 35 of the first leaf spring 31 partially extend into the area of the restriction body 20 or the free section 26. Therefore, the free section 26 cooperates with the elastic body 40 to help in regulating the motional range of the metal leaf spring 30. Accordingly, when the conductive wire 50 (especially a large-diameter conductive wire) is plugged into the conductive component to push/press the tail section 35 of the metal leaf spring to swing toward the upper side of the drawing, the metal leaf spring 30 is prevented from being over-biased and elastically deformed.

Figure 6:
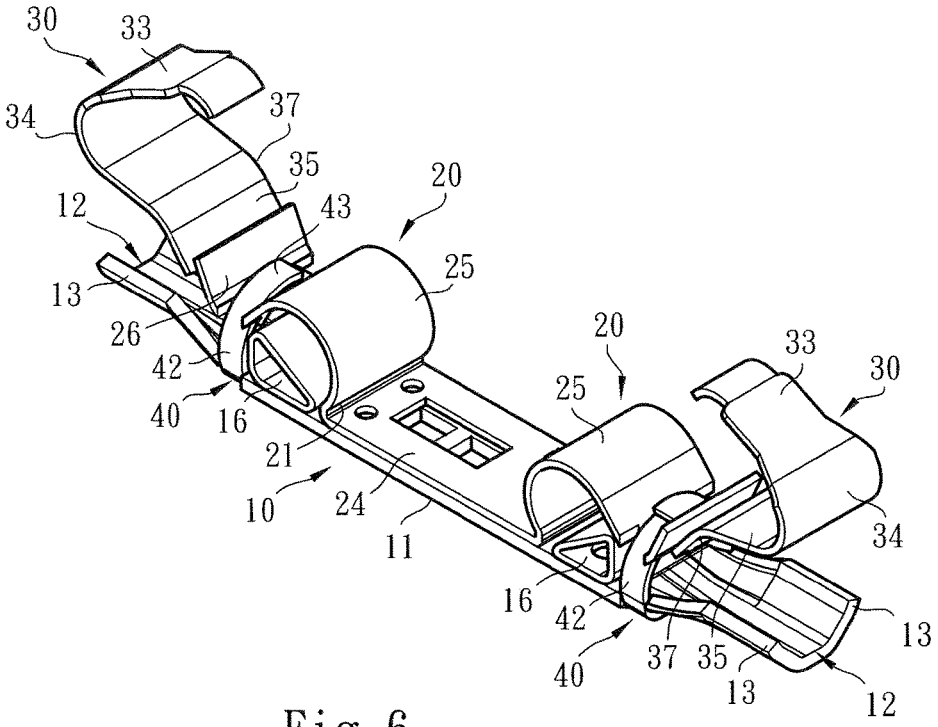
FIG. 6 is a perspective view of a modified embodiment of the present invention.

FIG. 6 shows a modified embodiment of the conductive component. In this embodiment, two restriction bodies 20 are respectively disposed at the two end sections 12 of the main body 10. The base sections 24 of the two restriction bodies 20 are integrally connected. In addition, the stop section 16 can be selectively made of plastic material or the like material as a block body with a geometrical configuration.

Figure 7:
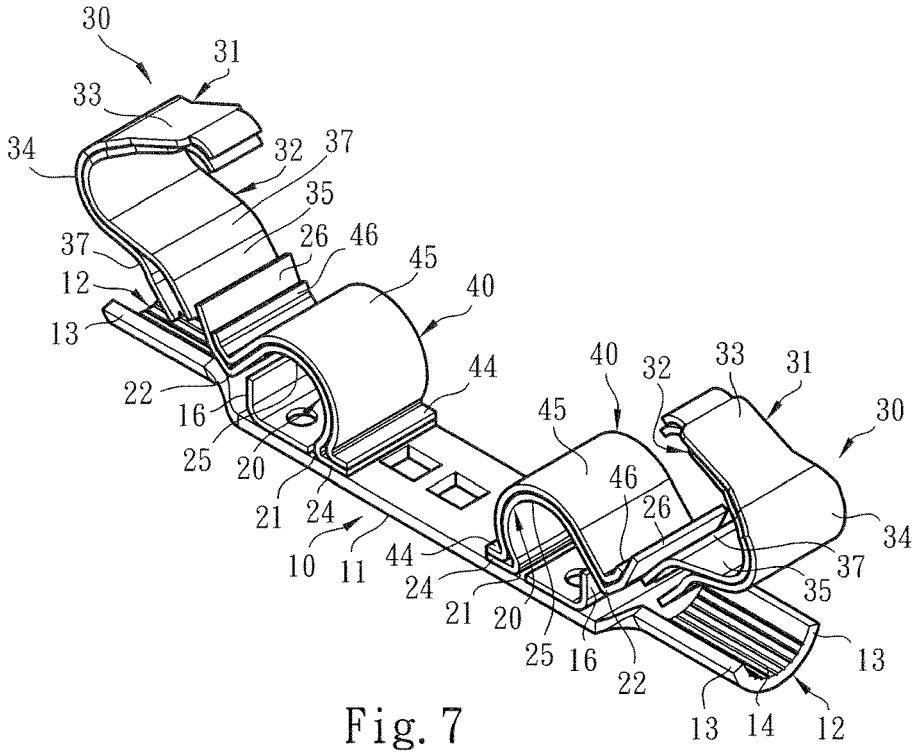
FIG. 7 is a perspective view of a modified embodiment of the present invention.
Figure 8:
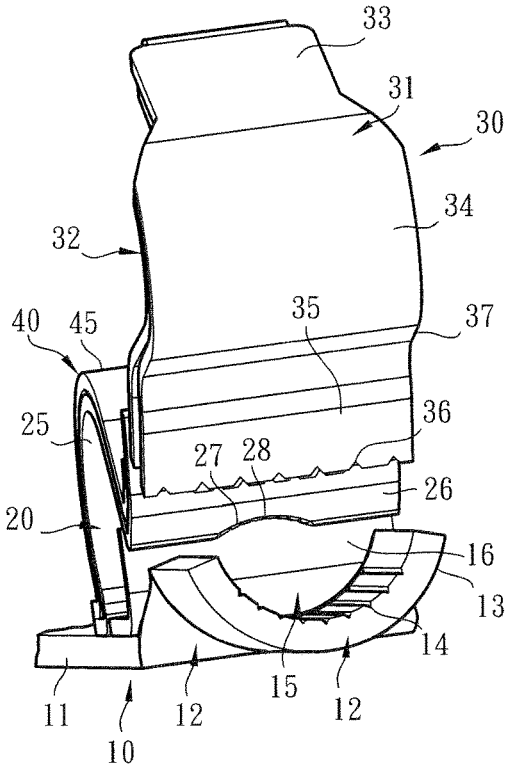
FIG. 8 is a perspective view showing the structure of a part of the present invention.
Figure 9:
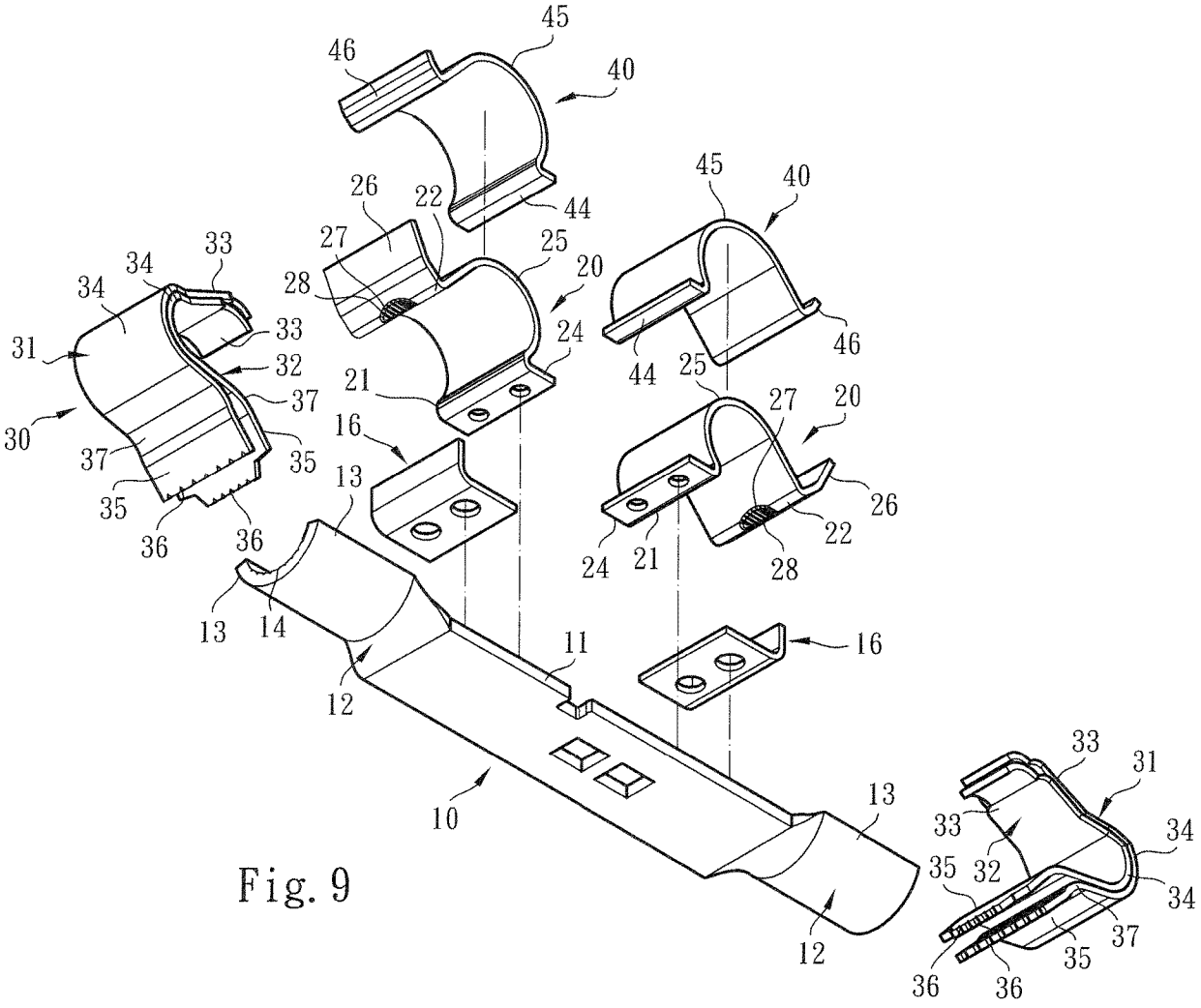
FIG. 9 is a perspective exploded view according to FIG. 7, showing the structures of the conductive component, the metal leaf spring and the elastic body.

Please now refer to FIGS. 7, 8 and 9, which show a modified embodiment of the conductive component. In this embodiment, the two end sections 12 and/or the (arched) bent edges 13 of the main body 10 are formed with multiple channels 14 for enhancing the stability of the assembly of the conductive wire 50 and the conductive component.

Figure 10:
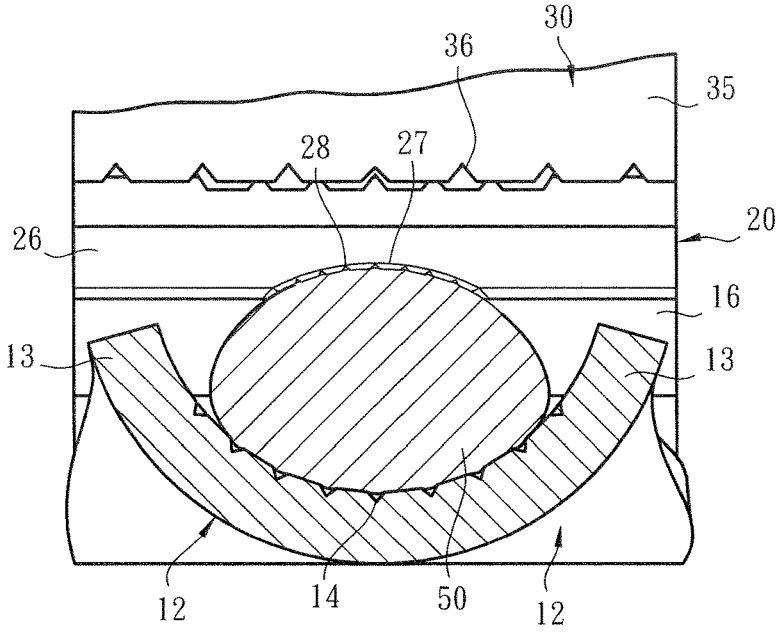
FIG. 10 is a sectional view of the present invention assembled with a conductive wire, showing that the main body and the restriction body are assembled with the conductive wire.

FIG. 10 especially shows that when the conductive wire 50 is plugged into the conductive component, the depression 27, the retarding section 28 and the bent edges 13 and the channels 14 of the main body together hold the upper section, the lower section and the lateral sides of the conductive wire 50 to enhance the stability of the assembly.

Figure 11:
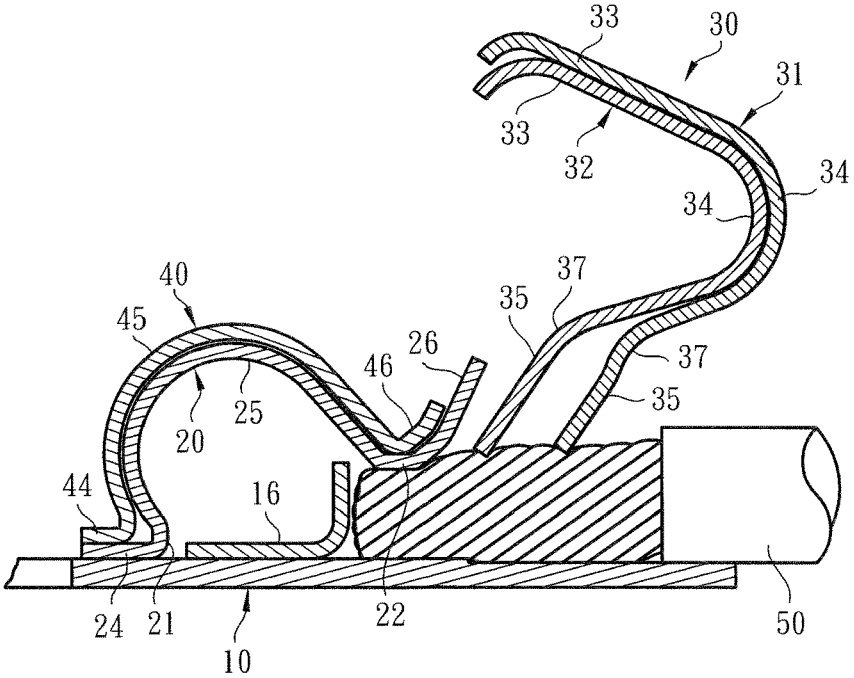
FIG. 11 is a sectional view showing the operation of the present invention, in which the conductive component, the metal leaf spring and the elastic body securely press and restrict the conductive wire.
Figure 12:
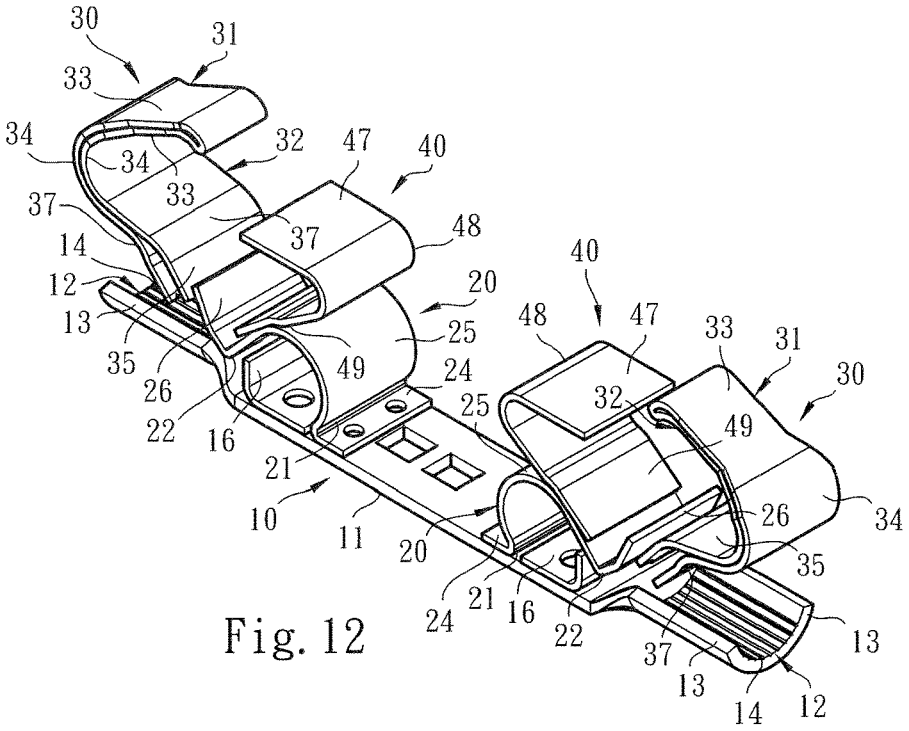
FIG. 12 is a perspective view of a preferred embodiment of the present invention.
Figure 14:
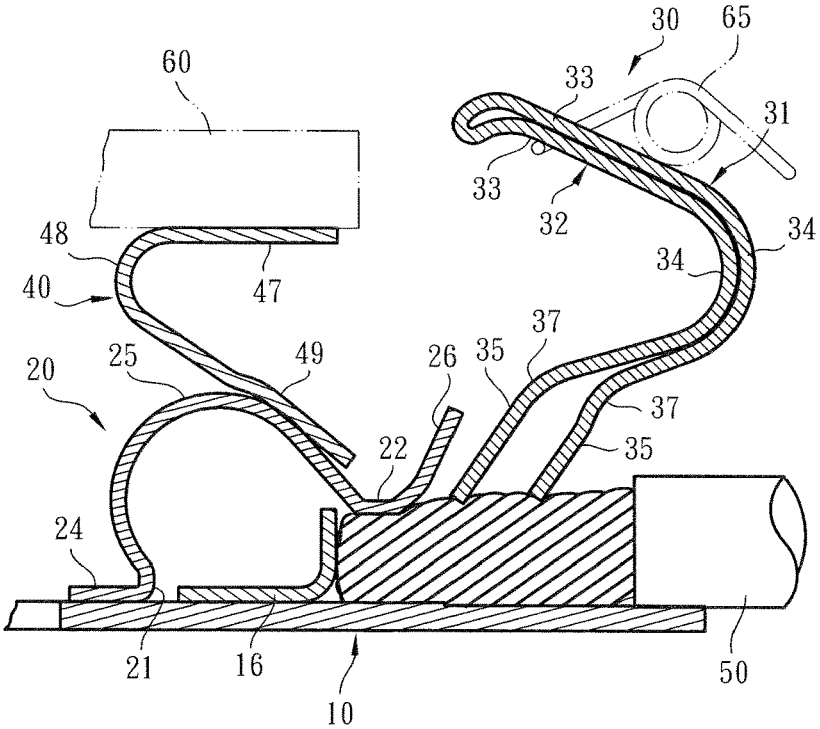
FIG. 14 is a sectional view showing the operation of the present invention, in which the conductive component, the metal leaf spring and the elastic body cooperate with the protrusion section to securely press and restrict the conductive wire.
Figure 13:
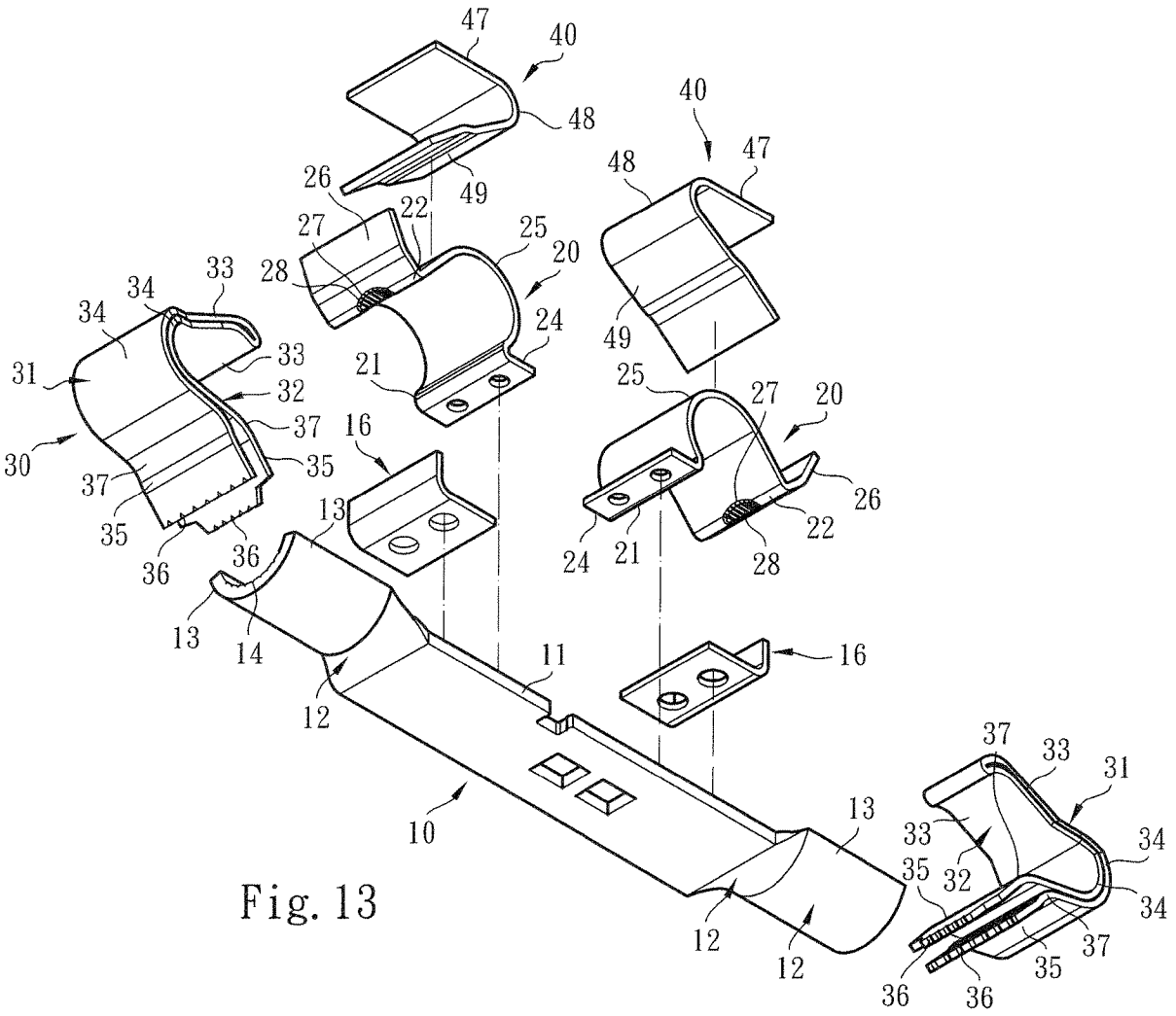
FIG. 13 is a perspective exploded view according to FIG. 12, showing the structures of the conductive component, the metal leaf spring and the elastic body.

In this embodiment, the elastic body 40 is formed with a substantially Ω-shaped structure or a structure similar to the restriction body 20. Accordingly, the elastic body 40 has a base section 44, a bow section 45 connected with the base section 44 and a free section 46 connected with the bow section 45. The base section 44, the bow section 45 and the free section 46 of the elastic body 40 can be overlaid on the base section 24, the bow section 25 and the free section 26 of the restriction body 20 to enhance the elastic pressing force of the restriction body 20 as shown in FIG. 11. Please now refer to FIGS. 12, 13 and 14, which show a preferred embodiment of the conductive component. In this embodiment, the elastic body 40 has the form of a V-shaped plate body having a head section 47, a bight section 48 connected with the head section 47 and a tail section 49 connected with the bight section 48.

In this embodiment, the head section 47 is connected with a protrusion section 60. The protrusion section 60 serves as a support point for the elastic body 40, whereby the tail section 49 can lean on the restriction body 20 (or the bow section 25) to enhance the elastic pressing force of the restriction body 20.

It should be noted that the protrusion section 60 can be connected and formed on the elastic body 40 and fixed on the other part (such as the insulation case) of the wire connection terminal. Alternatively, the protrusion section 60 can be formed on the other part of the wire connection terminal.

As shown in the drawings, the head sections 33 of the first and second leaf springs 31, 32 are connected with each other, whereby the first and second leaf springs 31, 32 are formed as an integrated structure. In addition, the head sections 33 of the metal leaf spring 30 can cooperative with a spring 65 mounted in the case to enhance the action force of the tail sections 35 for pressing and restricting the conductive wire 50.

To speak representatively, in comparison with the conventional wire connection terminal, the conductive component structure for the wire connection terminal of the present invention has the following advantages:

1. The main body 10, the restriction body 20, the metal leaf spring 30 and the elastic body 40 of the conductive component and the relevant components and structures have been redesigned. For example, the two end sections 12 of the main body 10 are formed with (arched) bent edges 13 and/or channels 14. The restriction body 20 includes a base section 24, a bow section 25 and a free section 26. A first bent section 21 is formed between the base section 24 and the bow section 25. A second bent section 22 is formed between the bow section 25 and the free section 26. The second bent section 22 has a depression 27. The restriction body 20 is assembled with the elastic body 40. The elastic body 40 includes a base section 41 and two arched waist sections 42 extending from two ends of the base section 41. The tail ends 43 of the two waist sections 42 are overlapped with each other. Alternatively, the elastic body 40 is formed with a substantially Ω-shaped structure or a structure similar to the restriction body 20. The elastic body 40 has a base section 44, a bow section 45 and a free section 46. Alternatively, the elastic body 40 has the form of a V-shaped plate body having a head section 47, a bight section 48 and a tail section 49 in cooperation with the head section 33 and the tail section 35 of the metal leaf spring 30. This is obviously different from the conventional wire connection terminal in use and operation form. Also, the present invention changes the electro-conductive structure or assembling relationship of the conventional wire connection terminal.
2. The main body 10 and the restriction body 20 are assembled with the elastic body 40 to enhance the elastic action force of the restriction body 20. The main body 10 and the restriction body 20 cooperate with the metal leaf spring 30 form a multipoint system for fixing the conductive wire 50. This obviously enhances the force of the conductive component and/or the metal leaf spring 30 for pressing and restricting the conductive wire 50 and increases the electro-conductive contact area. Accordingly, the wire connection terminal is applicable to a large-diameter conductive wire. The present invention improves the shortcomings of the conventional structure that the pressing force applied to the conductive wire is insufficient and the conductive wire can be hardly securely pressed and restricted so that the electro-conductive efficiency is affected. Also, the present invention improves the shortcomings of the conventional structure that the conductive wire is apt to rotate, deflect or swing (due to incautious touch of an operator or the assembling process) to lead to poor contact and insecurity. Especially, the restriction body 20 of the conductive component provides a structure capable of helping the main body 10 to guide the conductive wire 50 to plug in and helping the metal leaf spring 30 in securely pressing and restricting the conductive wire 50. The present invention obviously improves the shortcoming of the conventional structure that it is quite troublesome and time-costing to use the screw to lock and restrict the conductive wire.

In conclusion, the conductive component structure for the wire connection terminal of the present invention is different from the conventional terminal device in space form and is advantageous over the conventional wire connection terminal. The conductive component structure for the wire connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A conductive component structure for wire connection terminal, comprising:

a main body made of electro-conductive material in the form of a plate body having a longitudinally-extended surface, the main body having lateral sides and two longitudinal end sections; and a restriction body integrally formed on the main body or assembled/disposed on the main body, the restriction body including a base section disposed on the longitudinally-extended surface of the main body, a bow section connected with the base section and a free section connected with the bow section, a first bent section formed between the base section and the bow section, a second bent section formed between the bow section and the free section for contact with a conductive wire inserted into the wire connection terminal, whereby the free section is spaced from the longitudinally-extended surface of the main body and obliquely extends in a direction away therefrom, the bow section and the free section together providing elastic effect for the restriction body.

2. The conductive component structure for wire connection terminal as claimed in claim 1, wherein the restriction body is made of metal material and disposed on the two end sections of the main body, the bow section being formed with an arched structure, the main body being provided with a stop section positioned in an area of the bow section of the restriction body, the two end sections of the main body being formed with bent edges upward extending from the lateral sides of the main body, whereby the two end sections of the main body are formed with an arched cross section structure, the stop section being formed as an L-shaped plate body or a block body with a geometrical configuration.

3. The conductive component structure for wire connection terminal as claimed in claim 1, wherein the restriction body is provided with an elastic body, the elastic body being formed as a ring-shaped plate body, the elastic body having a base section connected with the main body and two arched waist sections extending from two ends of the base section toward the bow section and the free section, tail ends of the two waist sections being overlapped with each other, at least the waist sections and the tail ends of the elastic body being able to elastically expand and restore to their home positions; the restriction body is formed with a recessed section between the bow section and the free section to receive and secure the elastic body.

4. The conductive component structure for wire connection terminal as claimed in claim 2, wherein the restriction body is provided with an elastic body, the elastic body being formed as a ring-shaped plate body, the elastic body having a base section connected with the main body and two arched waist sections extending from two ends of the base section toward the bow section and the free section, tail ends of the two waist sections being overlapped with each other, at least the waist sections and the tail ends of the elastic body being able to elastically expand and restore to their home positions; the restriction body is formed with a recessed section between the bow section and the free section to receive and secure the elastic body.

5. The conductive component structure for wire connection terminal as claimed in claim 1, wherein the restriction body is provided with an elastic body, the elastic body being formed with an Ω-shaped structure, the elastic body having a base section, a bow section connected with the base section and a free section connected with the bow section, the base section, the bow section and the free section of the elastic body being overlaid on the base section, the bow section and the free section of the restriction body.

6. The conductive component structure for wire connection terminal as claimed in claim 2, wherein the restriction body is provided with an elastic body, the elastic body being formed with an Ω-shaped structure, the elastic body having a base section, a bow section connected with the base section and a free section connected with the bow section, the base section, the bow section and the free section of the elastic body being overlaid on the base section, the bow section and the free section of the restriction body.

7. The conductive component structure for wire connection terminal as claimed in claim 1, wherein the restriction body is provided with an elastic body, the elastic body formed as a V-shaped plate body having a head section, a bight section connected with the head section and a tail section connected with the bight section, the head section being connected with a protrusion section, the protrusion section serving as a support point for the elastic body, whereby the tail section leans on the restriction body, the protrusion section being connected and formed on the elastic body or disposed on an insulation case.

8. The conductive component structure for wire connection terminal as claimed in claim 2, wherein the restriction body is provided with an elastic body, the elastic body formed as a V-shaped plate body having a head section, a bight section connected with the head section and a tail section connected with the bight section, the head section being connected with a protrusion section, the protrusion section serving as a support point for the elastic body, whereby the tail section leans on the restriction body, the protrusion section being connected and formed on the elastic body or disposed on an insulation case.

9. The conductive component structure for wire connection terminal as claimed in claim 1, wherein an arched depression is formed on the restriction body in a position of the second bent section, a retarding section with recessed/raised structures being disposed in the depression, the depression of the restriction body and the two end sections of the main body together defining a mouth section, whereby the conductive wire passes through the mouth section to be elastically securely pressed by the second bent section of the restriction body on the main body.

10. The conductive component structure for wire connection terminal as claimed in claim 2, wherein an arched depression is formed on the restriction body in a position of the second bent section, a retarding section with recessed/raised structures being disposed in the depression, the depression of the restriction body and the two end sections of the main body together defining a mouth section, whereby the conductive wire passes through the mouth section to be elastically securely pressed by the second bent section of the restriction body on the main body.

11. The conductive component structure for wire connection terminal as claimed in claim 1, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

12. The conductive component structure for wire connection terminal as claimed in claim 2, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

13. The conductive component structure for wire connection terminal as claimed in claim 3, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

14. The conductive component structure for wire connection terminal as claimed in claim 4, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

15. The conductive component structure for wire connection terminal as claimed in claim 5, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

16. The conductive component structure for wire connection terminal as claimed in claim 6, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

17. The conductive component structure for wire connection terminal as claimed in claim 7, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

18. The conductive component structure for wire connection terminal as claimed in claim 8, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

19. The conductive component structure for wire connection terminal as claimed in claim 9, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

20. The conductive component structure for wire connection terminal as claimed in claim 10, wherein the main body and the restriction body are mounted in a case in cooperation with a metal leaf spring, the metal leaf spring including a first leaf spring and a second leaf spring, each of the first and second leaf springs having a head section, a bight section connected with the head section and a tail section connected with the bight section, the tail sections of the first and second leaf springs being formed with saw-toothed structures, the head section and the bight section of the first leaf spring being overlaid on the head section and the bight section of the second leaf spring, the tail section of the first leaf spring and the tail section of the second leaf spring being respectively formed with a bent section, whereby the tail section of the first leaf spring and the tail section of the second leaf spring are separated from each other.

21. The conductive component structure for wire connection terminal as claimed in claim 11, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

22. The conductive component structure for wire connection terminal as claimed in claim 12, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

23. The conductive component structure for wire connection terminal as claimed in claim 13, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

24. The conductive component structure for wire connection terminal as claimed in claim 14, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

25. The conductive component structure for wire connection terminal as claimed in claim 15, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

26. The conductive component structure for wire connection terminal as claimed in claim 16, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

27. The conductive component structure for wire connection terminal as claimed in claim 17, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

28. The conductive component structure for wire connection terminal as claimed in claim 18, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

29. The conductive component structure for wire connection terminal as claimed in claim 19, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

30. The conductive component structure for wire connection terminal as claimed in claim 20, wherein at least one of the tail section of the first leaf spring and the tail section of the second leaf spring partially extends into an area of the free section of the restriction body, the two end sections of the main body being formed with multiple channels, the head sections of the first and second leaf springs being connected with each other, whereby the first and second leaf springs are formed as an integrated structure, the head sections of the metal leaf spring being assembled with a spring mounted in the case.

* * * * *